US005129780A

United States Patent [19]

Stumpe

[11] Patent Number: 5,129,780

[45] Date of Patent: Jul. 14, 1992

[54] HYDRA-LIFT STAND FOR LOADERS

[75] Inventor: Leroy B. Stumpe, Hartford, S. Dak.

[73] Assignee: Du-Al Manufacturing Company, Sioux Falls, S. Dak.

[21] Appl. No.: 559,725

[22] Filed: Jul. 30, 1990

[51] Int. Cl.[5] ..... E02F 3/627

[52] U.S. Cl. ..... 414/686; 172/273

[58] Field of Search ..... 414/686, 694, 920, 680; 172/272-275

[56] References Cited

U.S. PATENT DOCUMENTS

| | | | |
|---|---|---|---|
| 4,275,984 | 6/1981 | Lenertz | 414/686 |
| 4,498,839 | 2/1985 | Williams et al. | 414/686 |
| 4,522,554 | 6/1985 | Williams et al. | 414/686 |

*Primary Examiner*—Robert J. Spar
*Assistant Examiner*—Donald W. Underwood
*Attorney, Agent, or Firm*—Hill, Van Santen, Steadman & Simpson

[57] ABSTRACT

A method and apparatus for supporting a loader on the ground and lifting parts of the loader above the tractor for disengagement from the tractor wherein the loader includes vertical side columns for detachable attachment to a tractor at their base, parallel side frame members pivotally attached at their rear ends to said column, double acting hydraulic lift cylinders connected to the outer ends of the frame members and to the columns at a location below the frame member attachment so that the frame member will be pivoted up or down with expansion or contraction of the cylinders, loader bucket supports extending downwardly from the forward end of the frame members carrying a loader bucket at their lower ends, and a lift stand carried at the lower end of the supports and stored on the supports during normal operation of the loader but foldable and expansible to a ground engaging position and a frame member support position for supporting the loader so that the rear end of the frame members can be lifted clear of the front wheels of the tractor when the loader is to be dismounted from the tractor.

10 Claims, 2 Drawing Sheets

FIG. 2
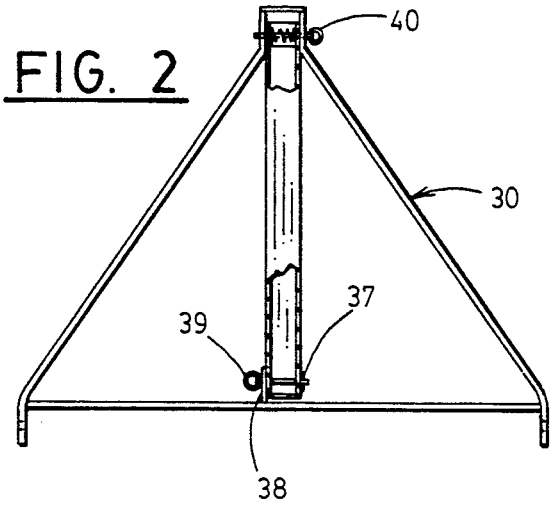
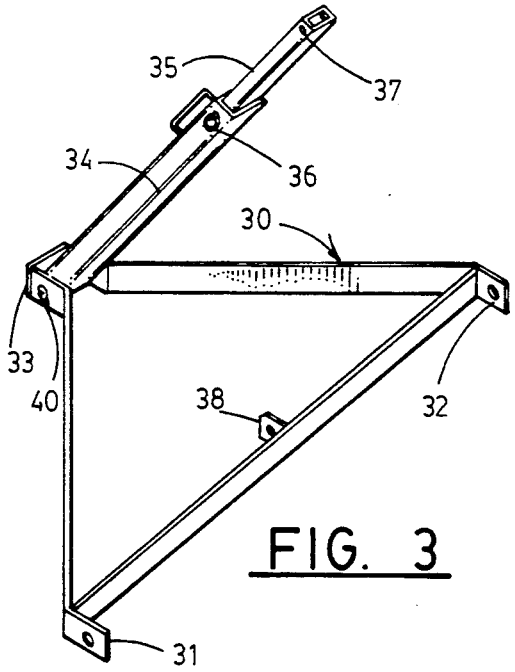
FIG. 3
FIG. 1
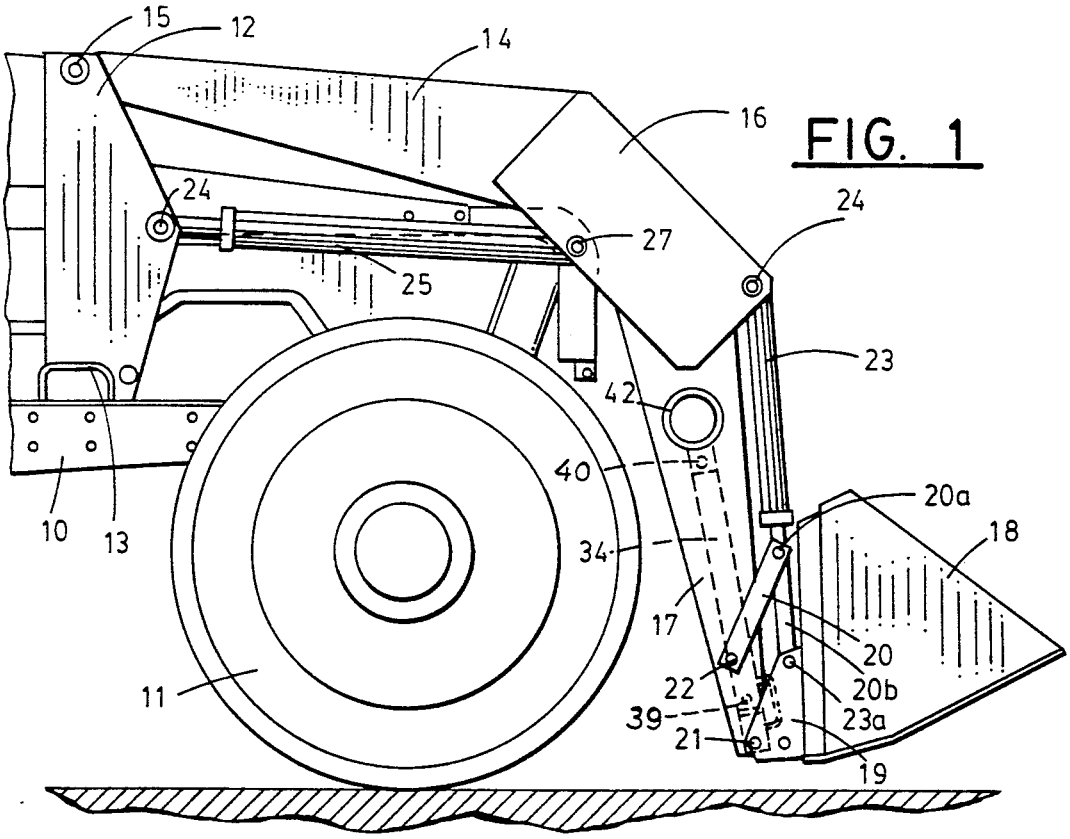

HYDRA-LIFT STAND FOR LOADERS

BACKGROUND OF THE INVENTION

The present invention relates to improvements in tractor loaders, and more particularly to a tractor loader structure and method of mounting the structure with an improved loader parking stand.

More particularly, the invention provides a tractor loader with a parking stand which is carried on the loader in normal loading operation and which can be positioned so that it will automatically lift the loader off of the tractor when the loader is disconnected in such a manner that the loader parts will lift up and clear the front wheels and fenders of front wheel drive tractors.

Power loaders are attached to tractors to provide a structure for lifting and loading or moving material. The tractor is provided with a hydraulic pump for pressurizing hydraulic fluid to operate the loader. When the loader is to be removed from the tractor and stored or interchanged with another device, it is desirable to have a structure whereby the loader can be quickly detached and stored so that the tractor can be connected to another appliance. Also, the loader should be maintained in a position to where it can be quickly reattached to the tractor.

The mechanical loaders are very bulky and heavy so that the parts cannot readily be manually handled. Difficulty exists in that the hydraulic equipment for operating the loader does not readily lend itself to functioning as an assist for attachment or removal of the loader from the tractor without unique design. A further problem exists in that large mechanical tractors are equipped with mechanical front wheel drives and front fenders which occupy a large part within the loader profile. This situation makes loader removal or attachment difficult as the rear of the loader frame must pass above the front tires and fenders.

An object of the present invention is to provide an improved hydraulic tractor loader which avoids disadvantages of structures heretofore available and provides for hydraulic operators which function not only to operate the loader in an optimum fashion but which also function to assist in the attachment or detachment of the loader from the tractor.

A further object of the invention is to provide an improved loader design which is relatively easy to remove or reattach to a tractor, having a minimum number of parts for repair and maintenance.

A still further object of the invention is to provide a unique tractor loader which utilizes hydraulic cylinders for operation and utilizes the same hydraulic cylinders for lifting the parts of the loader clear of the front wheels and fenders of a front wheel drive tractor when removing or attaching the loader.

A further object of the invention is to provide a unique parking stand for a tractor loader which aids in the removal of the loader from the tractor and which safely and reliably parks the loader when detached from the tractor.

FEATURES OF THE INVENTION

In accordance with the concepts of the invention, the present loader allows the tractor operator to control the attachment or removal of the loader from the tractor seat using the convenience of existing hydraulic components which are necessary for loader operation. A unique stand is provided which accomplishes this convenience and which is uniquely carried on the loader during normal operation so that it is always readily available. The innovative parking stand does not require any lifting or assembly but is merely pivoted down to a parking position and a telescoping tube is pinned to the loader main frame to provide a parking linkage. When the parking stand is in place, the operator can remove the loader hitching pins and automatically use the lift cylinders to lift the parts of the loader which must clear the front wheels and fenders of the tractor. When the loader is in parked position, the operator can retract the lift cylinders which protect the chrome shafting of the piston rods so that they are not exposed to atmosphere which can cause rusting over extended periods of time. This also lowers the loader frame to park it safely and securely. The hydraulic lines then are easily disconnected from the tractor and the loader is parked ready for reattachment.

Other objects, features and advantages will become more apparent with the teachings of the principles of the invention in connection with the disclosure of the preferred embodiments in the specification, claims and drawings, in which:

DESCRIPTION OF THE DRAWINGS

FIG. 1 is a side elevational view of the front end of a tractor with a loader embodying the principles of the present invention;

FIG. 2 is a detailed plan view of a part of the parking stand structure;

FIG. 3 is a perspective view of the parking stand structure of FIG. 2;

DESCRIPTION OF THE PREFERRED EMBODIMENTS

Figure 4:
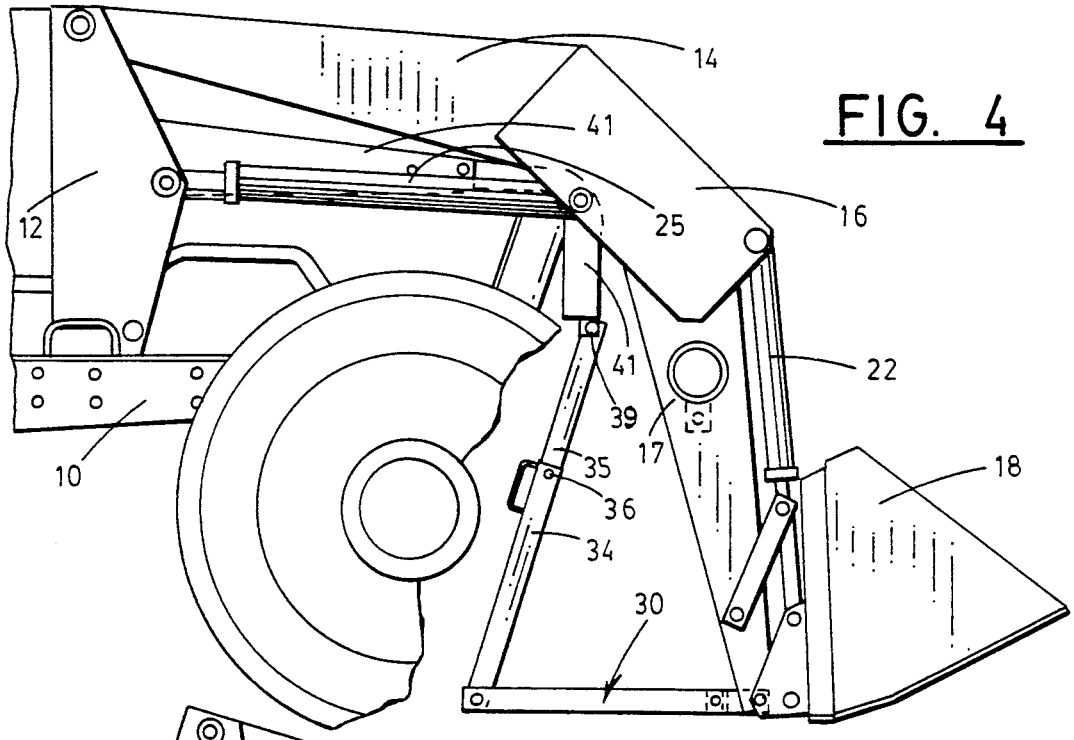
FIG. 4 is a side elevational view of the front end of a tractor illustrating the parking stand placed in position for use.
Figure 5:
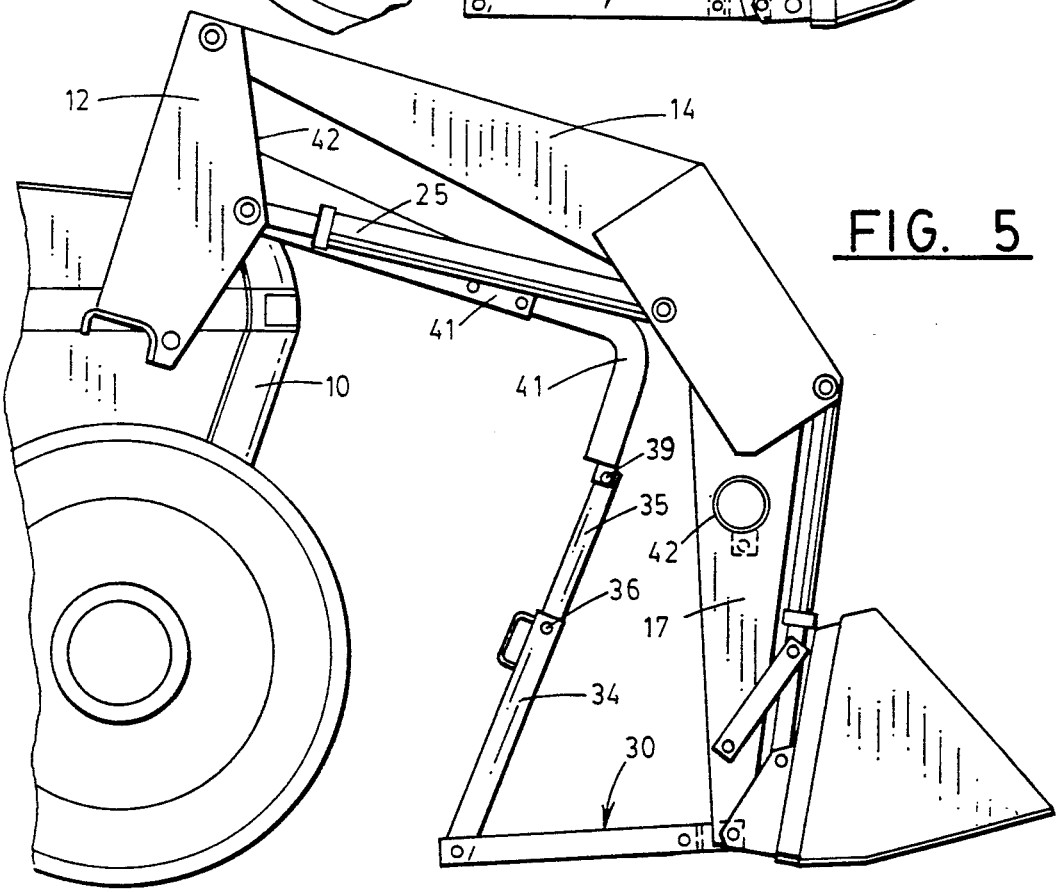
FIG. 5 is a side elevational view of the loader being removed using the parking stand.

As best shown in FIGS. 1, 4 and 5, a tractor 10 has a loader detachably mounted thereon. The tractor is shown of the front wheel drive type having relatively large front wheels 11 which must be cleared when the loader is taken off of the tractor or when it is attached to the tractor.

The loader includes a vertical column 12 which has a saddle arrangement 13 at its lower end which allows it to clamp to the tractor by releasable means, not shown in detail. Such means may include a pin arrangement slidable into holes of the type which will be recognized by those versed in the art.

It will be understood that the loader includes columns such as 12 at each side of the tractor and such basic loader equipment is well known as shown, for example, in U.S. Pat. No. 4,637,772, Stumpe, Issued Jan. 20, 1987.

Attached to each of the vertical columns 12 are frame member arms 14 which extend parallel to each other at each side of the loader. The frame member arms are pivotally attached to the column at 15 at their rear ends. At the front ends of the frame member arms are vertical loader bucket support extensions 17 which are rigidly connected to the frame member arms and thereby become part of the frame member arms. The vertical supports 17 are secured to the frame member arms by flat plates 16 which can be welded to the faces of the supports 17 and arms 14.

The supports carry at their lower ends a loader bucket 18 which is pivotally mounted thereto by a loader bucket supporting bracket 19 which is pivoted at 21. The loader bucket is maintained in its scooping posture by an arm 20 which is pivotally connected to the support 17 at 22. The arm 20 is pivoted at its upper end 20*a* to a link 20*b* on the loader bucket. The bracket 19 and arm 20 provide a parallelogram link to keep the loader bucket in the posture shown in the figures. The loader bucket is tiltable, however, and for this purpose, a hydraulic operating cylinder and piston 23 are mounted on the support with the upper end of the cylinder being pivotally connected at 24 to the plate 16 and pivotally connected at its lower end essentially at the point 23*a* to the loader bucket. Operation of the operating cylinder 23 will tilt the loader bucket 18 to the angle desired.

The tractor will have a hydraulic pump and hydraulic hoses, not shown, will be connected to the ends of the cylinder 23 operated by valves accessible to the tractor operator.

The frame members 14 are swung about their pivotable points 15 to raise the loader bucket by the operation of an operating cylinder 25 which is pivotally connected at one end 24 to the vertical column 12 and at the other end 27 to the frame member by being connected to the plate 16. Expansion of the operating cylinder 25 will, of course, raise the frame members. As will be recognized by those versed in the art, the loader bucket 18 will be tilted to the desired position, the tractor will be driven forward to load the loader bucket and the frame members will be raised to move the loader bucket above a truck or a location where the contents of the loader bucket are to be dumped and the loader bucket is then tilted to drop its load.

The mechanism for parking the loader above described can be best viewed in FIGS. 4 and 5 with a detail of a major portion of the parking equipment shown in FIGS. 2 and 3.

The lift stand is shown at 30 in FIGS. 2 and 3. In FIG. 1 the lift stand is in its storage position where it is carried on the frame member by being carried between the loader bucket supports 17. For this purpose, a cross bar 42 extends between the supports 17. The upper end of the lift stand connects to the bar 42 by passing a pin 40 through the opening for pin 40 FIG. 3.

The lift stand is pivotally connected at its lower end at its sides 31 and 32 to the lower end of the supports 17 and being pivotal can be moved from its storage position as shown in FIG. 1 to the loader support or parking position shown in FIGS. 4 and 5.

The lower link of the lift stand is triangularly shaped with sides that converge in an apex 33 where an upper pivotal link 34 is pivotally connected at 40. The upper link is telescoping having a lower female portion and an upper male portion 35 which slides in the portion 34 to be fully recessed in the storage position and to be extended in the parking position.

In the parking position, the lower triangular link 30 is pivoted downward to rest on the ground and the upper link 34 is extended by drawing out the male telescoped portion 35. It is locked in its extended position by a cross pin 36. The upper end of the link has an opening 37 to be connected to a rigid arm 41. The base of the rigid arm is welded to the upright column 12 at 42.

When the operator places the parking stand in the position shown in FIG. 4, he then expands the hydraulic cylinder 25, and these forces will tend to tilt the support 17 forwardly which pivots the frame member arms 14 upwardly from the position of FIG. 4 to FIG. 5. The columns 12 will then be raised off of their saddle supports, having been first released from the tractor, and the tractor can be backed out of the loader. When the tractor is clear of the loader, the cylinder 25 is contracted to lower the frame member arms 14 and drop them to a lowered stable parking position. The loader can then remain in that position until it is needed for further use. The hydraulic lines, of course, will be disconnected from the tractor to remain with the loader.

When further use is required, the hydraulic lines are again reconnected, and the operator expands the cylinder 25 to raise the frame member arms 14 to the position shown in FIG. 5, the tractor is driven into position and the cylinder 25 is then released to drop the columns 12 so that the saddles at their base engage the tractor and can be locked into place.

The upper link of the parking stand can be released by removing the pin 39. The pin 36 is then removed so that the upper male portion 35 can be telescoped into the lower portion 34 and the link 34 then folded down into the triangular shaped lower link 30. A lug 38 is located on the cross bar of the triangular lower link so that the pivotal arm 34 can be locked to the triangle. The triangle is then folded up to the position of FIG. 1 and locked in place by reinserting the pin 40 to attach it to the cross bar 42. The parking stand is thus held in place and stored on the loader during normal use of the loader to be immediately and readily available when the loader is to be removed from the tractor.

In operation as shown in FIG. 1, the loader is mounted on the tractor 10 and the loader bucket 18 is tilted by operation of the hydraulic cylinder 23. The frame members 14 are raised and lowered by operation of the hydraulic cylinder 25.

When the loader is to be removed, the first step in parking is to remove the pin 40 to pivot the lower link 30 down to the horizontal position to lie on the ground as shown in FIGS. 4 and 5. The link 34 is then pivoted upwardly and the upper portion 35 withdrawn and locked in the withdrawn position by pin 36, and the upper end of the extension 35 is pinned to the rigid arm 41 by a pin 39. The column 12 is then released at its lower end from the tractor, and the hydraulic cylinder 25 expanded which causes forces that pivot the supports 17 forwardly to raise the frame member arms and the columns 12 to the position of FIG. 5 so that they clear the front wheels and fenders of the tractor. The tractor then can be backed away. The cylinders can then be collapsed with the piston rods withdrawn which will lower the frame member arms 12 for safe parking of the loader.

Thus, it will be seen that there has been provided an improved loader and parking arrangement which accomplishes the objectives above set forth and provides a simplified unit utilizing the frame member tilting cylinder for a parking assist in raising the rear end of the frame member arms to clear the tractor for either detachment from the tractor or reattachment. The cylinder can then be collapsed to protect the exposed metal of the piston rods to avoid rust.

I claim as my invention:

1. A tractor operated power loader comprising in combination:

vertical side columns adapted for detachable attachment to a tractor at their base;

parallel side frame members pivotally attached at their rear ends to said columns;

double acting hydraulic lift cylinders connected to a forward end of said frame members and to the columns at a location below the frame member attachment so that the frame member will be pivoted up or down with expansion or contraction of the cylinders;

loader bucket extending downwardly and carrying a loader bucket at their lower ends being supported at their upper ends by the forward ends of the frame member;

rigid arms mounted on the side columns; and a lift stand pivotally mounted on the lower end of the support and pivotally movable between a storage position and a loader support position, the stand carried on the supports in said storage position, the stand connected between the rigid arms and supports in ground engaging position so that the loader is supported by the loader bucket and lift stand in said loader support position.

2. A tractor operated power loader constructed in accordance with claim 1:

wherein said lift stand is constructed of plural parts pivotally attached and foldable to be carried on the supports in the storage position.

3. A tractor operated power loader constructed in accordance with claim 1:

wherein said lift stand has a lower portion triangular in shape with legs pivotally connected to the supports and an apex being ground engageable in loader support position.

4. A tractor operated power loader constructed in accordance with claim 1:

wherein said lift stand has a lower part being connected to the supports and an upper part being connectable to the rigid arms and being telescopically extensible.

5. A tractor operated power loader constructed in accordance with claim 1:

wherein said lift stand has a lower part and an upper part with said parts pivotally connected to each other and foldable to move to the storage position.

6. A tractor operated power loader constructed in accordance with claim 1:

wherein said lift stand includes first and second parts pivotally interconnected and foldable for movement to said storage position.

7. A tractor operated power loader constructed in accordance with claim 1:

wherein the loader includes an attachment on the rigid arms for detachable connection of the lift stand.

8. A tractor operated power loader constructed in accordance with claim 1:

including a second hydraulic cylinder connected between the loader bucket and the loader bucket supports.

9. A tractor operated power loader constructed in accordance with claim 1:

including a releasable attachment on the base of each of the side columns for attachment to a tractor.

10. A tractor separated power loader comprising in combination:

vertical side columns adapted for detachable attachment to a tractor at their base;

parallel side frame members pivotally attached at their rear ends to said columns;

double acting hydraulic lift cylinders connected to a forward end of said frame members and to the columns at a location below the frame members attachment so that the frame member will be pivoted up or down with expansion or contraction of the cylinders;

loader bucket supports extending downwardly and carrying a loader bucket at their lower ends being supported at their upper ends by the forward ends of the frame members;

a lift stand movable between a storage position on the supports and a loader holding position having a triangular shaped lower link pivotally connected at one end to the lower end of the supports, an apex end of the lower link positioned to be in ground engagement position spaced from the loader bucket when the loader bucket is supported and detached from the tractor;

a rigid position on said side columns; and a connecting link at said apex end for disconnectably connecting to a said rigid portion on the side columns to support the loader when disconnected from the tractor.

* * * * *